US008056548B1

(12) United States Patent
Larson

(10) Patent No.: US 8,056,548 B1
(45) Date of Patent: Nov. 15, 2011

(54) STRING VIBRATION SUPPRESSOR FOR COMPOUND ARCHERY BOWS

(75) Inventor: Marlow W. Larson, Ogden, UT (US)

(73) Assignee: Larson Archery Company, Ogden, UT (US)

( * ) Notice: Subject to any disclaimer, the term of this patent is extended or adjusted under 35 U.S.C. 154(b) by 492 days.

(21) Appl. No.: 12/077,373

(22) Filed: Mar. 19, 2008

(51) Int. Cl.
*F41B 5/20* (2006.01)

(52) U.S. Cl. ..... 124/89; 124/23.1; 124/25.6; 124/86; 124/88; 124/90

(58) Field of Classification Search ..... 124/23.1, 124/25.6, 86, 88–90
See application file for complete search history.

(56) References Cited

U.S. PATENT DOCUMENTS

| | | | | | |
|---|---|---|---|---|---|
| 2,617,402 | A | * | 11/1952 | Roemer | 124/23.1 |
| 3,012,552 | A | * | 12/1961 | Allen | 124/23.1 |
| 3,070,083 | A | * | 12/1962 | Gubash | 124/23.1 |
| 3,258,000 | A | * | 6/1966 | Kolpacki | 124/23.1 |
| 3,486,495 | A | * | 12/1969 | Holless | 124/25.6 |
| 3,990,425 | A | * | 11/1976 | Ketchum | 124/25.6 |
| 4,061,125 | A | * | 12/1977 | Trotter | 124/23.1 |
| 4,461,267 | A | * | 7/1984 | Simonds et al. | 124/25.6 |
| 4,628,892 | A | * | 12/1986 | Windedahl et al. | 124/25.6 |
| 4,748,962 | A | * | 6/1988 | Larson | 124/25.6 |
| 4,774,927 | A | * | 10/1988 | Larson | 124/25.6 |
| 4,909,231 | A | * | 3/1990 | Larson | 124/23.1 |
| 4,919,108 | A | * | 4/1990 | Larson | 124/88 |
| 4,967,721 | A | * | 11/1990 | Larson | 124/25.6 |
| 5,323,756 | A | * | 6/1994 | Rabska | 124/86 |
| 5,720,269 | A | * | 2/1998 | Saunders | 124/86 |
| 6,634,348 | B2 | * | 10/2003 | Gallops, Jr. | 124/25.6 |
| 6,715,479 | B1 | * | 4/2004 | Bunk | 124/25.6 |
| 6,763,818 | B2 | * | 7/2004 | Larson | 124/25.6 |
| 6,966,312 | B1 | * | 11/2005 | Larson | 124/25.6 |
| 6,966,314 | B2 | * | 11/2005 | McPherson | 124/89 |
| 6,990,970 | B1 | * | 1/2006 | Darlington | 124/25.6 |
| 7,047,958 | B1 | * | 5/2006 | Colley | 124/25.6 |
| 7,721,724 | B2 | * | 5/2010 | Goade | 124/89 |
| 7,753,044 | B2 | * | 7/2010 | Goade | 124/89 |
| 7,793,646 | B2 | * | 9/2010 | Cooper et al. | 124/89 |
| 2003/0056779 | A1 | * | 3/2003 | Gallops, Jr. | 124/89 |
| 2003/0056780 | A1 | * | 3/2003 | Gallops, Jr. | 124/92 |
| 2003/0136392 | A1 | * | 7/2003 | McPherson | 124/25.6 |
| 2003/0168051 | A1 | * | 9/2003 | Andrews | 124/25.6 |
| 2006/0169260 | A1 | * | 8/2006 | Chang | 124/25.6 |
| 2008/0236559 | A1 | * | 10/2008 | Barnard | 124/89 |
| 2008/0264400 | A1 | * | 10/2008 | Wright | 124/89 |
| 2009/0133683 | A1 | * | 5/2009 | Wright | 124/89 |
| 2009/0145411 | A1 | * | 6/2009 | Sims et al. | 124/25.6 |
| 2010/0089375 | A1 | * | 4/2010 | McPherson et al. | 124/25.6 |

* cited by examiner

*Primary Examiner* — Gene Kim
*Assistant Examiner* — Alexander Niconovich
(74) *Attorney, Agent, or Firm* — Brian C. Trask

(57) ABSTRACT

A vibration dampening device for use on compound archery bows. A device may be associated with one or more bow limb, with each device disposing a vibration damping bumper in position to shorten the vibrating length of the bow string at brace, compared to the vibrating length of a bow string of a comparable bow lacking the device(s). Certain embodiments couple bowstring vibration at brace with one or more cable. Preferred embodiments include a limb anchor adapted to distribute string-induced loading onto a bow limb at both sides of a string cam.

20 Claims, 3 Drawing Sheets

STRING VIBRATION SUPPRESSOR FOR COMPOUND ARCHERY BOWS

BACKGROUND OF THE INVENTION

1. Field

This invention pertains to compound archery bows, and specifically to mechanisms for dampening string vibrations following the launch of an arrow.

2. State of the Art

Casting an arrow with an archery bow involves first nocking the arrow to a bowstring and then pulling the bowstring at the nock point from its rest (brace) position to a drawn position. The limbs of the bow are thereby flexed to store energy. The string is released to cast the arrow, and returns to its rest (or brace) position. The energy stored in the limbs is transferred primarily to the arrow, but in part to the string. This string energy is dissipated through vibrations. Such vibrations are regarded as undesirable for several reasons. A peculiar sensation is experienced by the archer as vibrations transfer through the grip of the bow to the archer's hand and forearm. Moreover, the vibrations create noise, much as the vibrating string of a musical instrument. In a hunting environment, silence is considered to be essential. String vibration also contributes to a foreshortened useful life for the bowstring, due to fatigue. String vibrations, and their attendant disadvantages are particularly evident in compound bows.

Compound bows are available in many configurations, most of which are classified as either "single cam" or "dual cam" bows. U.S. Pat. Nos. 3,486,495; 3,990,425; 4,748,962; 4,774,927; 4,967,721; 6,763,818 and 6,990,970, the disclosures of which are incorporated by reference, describe a variety of constructions of such bows, including both single cam and dual cam configurations of cross bows. These bows are characterized by riggings (sometimes called "cable means") that include a central stretch (bowstring) and multiple end stretches (cables) interconnecting opposed limb tips. The term "rigging" is intended to include such structure as pulley assemblies, bowstring, and cable(s) that are operable to flex the limbs of a bow as the bowstring is drawn. Most single cam bows and many dual cam bows include riggings that connect a pulley assembly carried by one limb to the opposite limb through a yoke (sometimes called a "Y" harness.) Such arrangements are characterized by riggings that include a bow string extending from a pulley member and a yoke harness extending from an axle member supporting that pulley member. The spacing between the string and harness changes as the string is moved between brace and drawn conditions. That spacing increases as the sting is drawn, and decreases as the string returns to brace condition following the launch of an arrow.

Various devices have been proposed to deaden or dampen string vibrations. For example, U.S. Pat. Nos. 4,061,125; 4,461,267; and 5,720,269 disclose various forms of string bumpers supported by the bow handle in position to contact the bow string in brace condition following launch of an arrow. U.S. Pat. No. 6,966,314 discloses a similar bumper arrangement (called a "suppressor") that includes a support adapted for rigid attachment to the end of a bow limb. The distal portion of the support is configured to hold vibration suppressing material, such an elastomer or gel, against the string in rest, or brace, position. Such a suppressor may be connected to one or both limbs of the bow. The device disclosed by the '314 patent applies force received from the bowstring to only one side of the bow limb (to a single limb of a split limb bow, or an equivalent location on other limbs).

This arrangement inherently imparts a twisting moment applied to the limb tip when the bow string encounters the damping element.

SUMMARY OF THE INVENTION

This invention provides a string vibration suppressor that is suspended from a pivot connection with the tip of a bow limb. While it is operable with compound bows generally, it is particularly well adapted for use on compound bows utilizing a yoke harness arrangement. The yoke may take various forms, but characteristically includes opposed stands that connect to opposite ends of an axle transverse the distal end of a bow limb. One embodiment of a suppressor of the instant invention comprises a bracket, or frame, element with approximately parallel side support members. Each side support has a proximal end, structurally adapted for pivot connection to the axle. Connection members associated with the side supports are configured to attach to respective opposed strands of a yoke so that they inherently pivot with respect to the axle as the yoke strands move during a shooting cycle. Distal portions of the side supports carry a dampening member (or "bumper") constructed of a vibration-absorbing material (usually of "rubbery" or elastomeric consistency).

When the suppressor of this invention is properly installed on a bow, the dampening member is desirably in contact with the bow string at brace condition. As the string is pulled at its nocking point, the geometry of the bow adjusts such that the cable (often in the form of a yoke) and string move apart. The dampening member is thereby separated from contact with the string. When the string is released, it returns to brace condition, in contact with the dampening member. The yoke (or other cable component), while taut, is nevertheless less apt to transfer vibrations back to the grip of the bow than are the more rigid mounting structures currently relied upon to hold string suppressors in operable position.

An installed bowstring suppressor structured according to the instant invention shortens the vibrating length of the bowstring after arrow launch. Such shortening causes the natural frequency of vibration of the remaining string span to increase. Consequently, the remaining string span of the bowstring vibrates more rapidly with the suppressor installed, and dissipates energy of vibration more rapidly and effectively into the atmosphere due to friction between the bowstring and air molecules.

For convenience, the bowstring stretch between the bumper component and the bowstring contact location at the string pulley may be called the "trimmed section" of bowstring. Because its length is much shorter, its fundamental frequency of vibration is exponentially higher than would be the case absent the suppressor. Consequently, the energy of vibration in the trimmed section is dissipated much more rapidly into the atmosphere. As the bowstring rebounds, it may (at least initially, and depending upon the relative position of the damping bumper component to natural bowstring position at brace) bounce away from contact with the bumper. In such case, vibration energy is pumped from the remaining bowstring portion into the trimmed section(s), effectively bleeding down the energy of vibration in the remaining bowstring portion at a faster rate than if the suppressor were not present.

Furthermore, resiliency in a bumper component provides a compliant boundary condition at the vibrating nodes of the remaining string span that also dissipates energy more rapidly than the relatively hard nodes formed on the contact surface of a pulley member. In practical terms, a hard pulley member provides an energy reflecting (essentially pinned) boundary condition, and the bumper component provides an energy absorbing node boundary condition.

Coupling the vibration displacement of the bowstring at or near brace with one other limb-tip-to-limb-tip cable essentially doubles the surface area (to that provided by the bowstring and cable) operable to dissipate the energy of vibration into the atmosphere. Similarly, coupling the bowstring with additional cables further increases the effective surface area for energy dissipation. Therefore, a string-cable coupled bow structured according to the instant invention exhibits much more rapid decay of bowstring vibration. Consequently, the bow is quieter in operation, and imparts less vibration into the hand and arm of the archer.

In certain preferred embodiments, a bowstring is coupled by way of an extension member to one or more cables at a mid-span location of the cable(s). For purpose of this disclosure, coupling mid-span to a cable is defined as arrangements wherein the location of energy transfer from the bowstring to at least one cable occurs spaced apart (however slightly) from a contact point of the cable with a pulley, axle, or limb of the bow. Therefore, energy from the bowstring is applied to cause a transverse displacement of the cable, at a location spaced apart from a node for vibration of the cable that is structurally imposed by a conventional rigging arrangement, e.g. conventionally at a cable anchor location, or contact with a pulley element.

A bowstring-cable coupled bow reduces displacement of a bow limb, caused by twisting torque applied to the bow limb tip by the bowstring, compared to a vibration suppressor that anchors to only one side of a bow limb. Such limb displacement is reduced because the force applied by the bowstring is distributed to both the limb tip and to a cable. Therefore, the force applied to the limb anchor interface (even on a single-side of a limb) is reduced, compared to a non-coupled configuration. Consequently, the displacement caused by applying a twisting torque to a bow limb tip by a bowstring vibration dampening device including bowstring-cable coupling is reduced compared to a string vibration suppressor that anchors to only one side of a bow limb.

In summary, this invention provides a vibration suppressor for installation in association with the rigging of a compound bow. It includes a bowstring vibration dampening bumper component structured and arranged for installation on such a bow at a location spaced apart from and between respective bowstring cams of the bow. The bumper component is thereby positioned in contact with the bowstring when the bowstring is near brace, and out of contact with the bowstring at full draw. The suppressor further includes coupling structure, which when positioned between the bowstring and a cable of the rigging, is effective to transfer a portion of energy in the released bowstring into a transverse displacement of the cable.

The coupling structure typically comprises an extension member disposed to transfer energy received from the bowstring into the cable at a mid-span location of the cable. An associated anchor structure is configured to maintain the bumper component in spaced apart relation from at least one side of a limb tip of the bow. The anchor structure comprises at least one attachment interface adapted to couple with structure carried at the end of a bow limb. It may also include a second attachment interface. The first and second attachment interfaces are advantageously spaced apart on opposite sides of a bowstring cam element of the bow. For example, the attachment interfaces may be structured to couple with an axle of a pulley assembly of the bow. The anchor structure is desirably configured and arranged to hold the suppressor in association with a limb in a fashion that resists displacement caused by application of twisting torque caused by contact of the suppressor by the bowstring.

The coupling structure may also include adjustment mechanism operable to change the specific position of the bumper component with respect to an attachment interface, whereby to accommodate pulley elements of different size when the suppressor is installed on a different bow. Optional location structure, extending from the anchor structure, serves to place the bumper component in contact with the bowstring at a location spaced apart from and between respective string cams of the bow.

The suppressors of this invention may be dimensioned for use with bows of predetermined geometry, but preferred embodiments include adjustment features that permit interchangeable use with bows of various configuration.

BRIEF DESCRIPTION OF THE FIGURES

In the Drawings, which illustrate what are regarded as the best modes for carrying out the invention.

DETAILED DESCRIPTION OF THE ILLUSTRATED EMBODIMENTS

Figure 1:
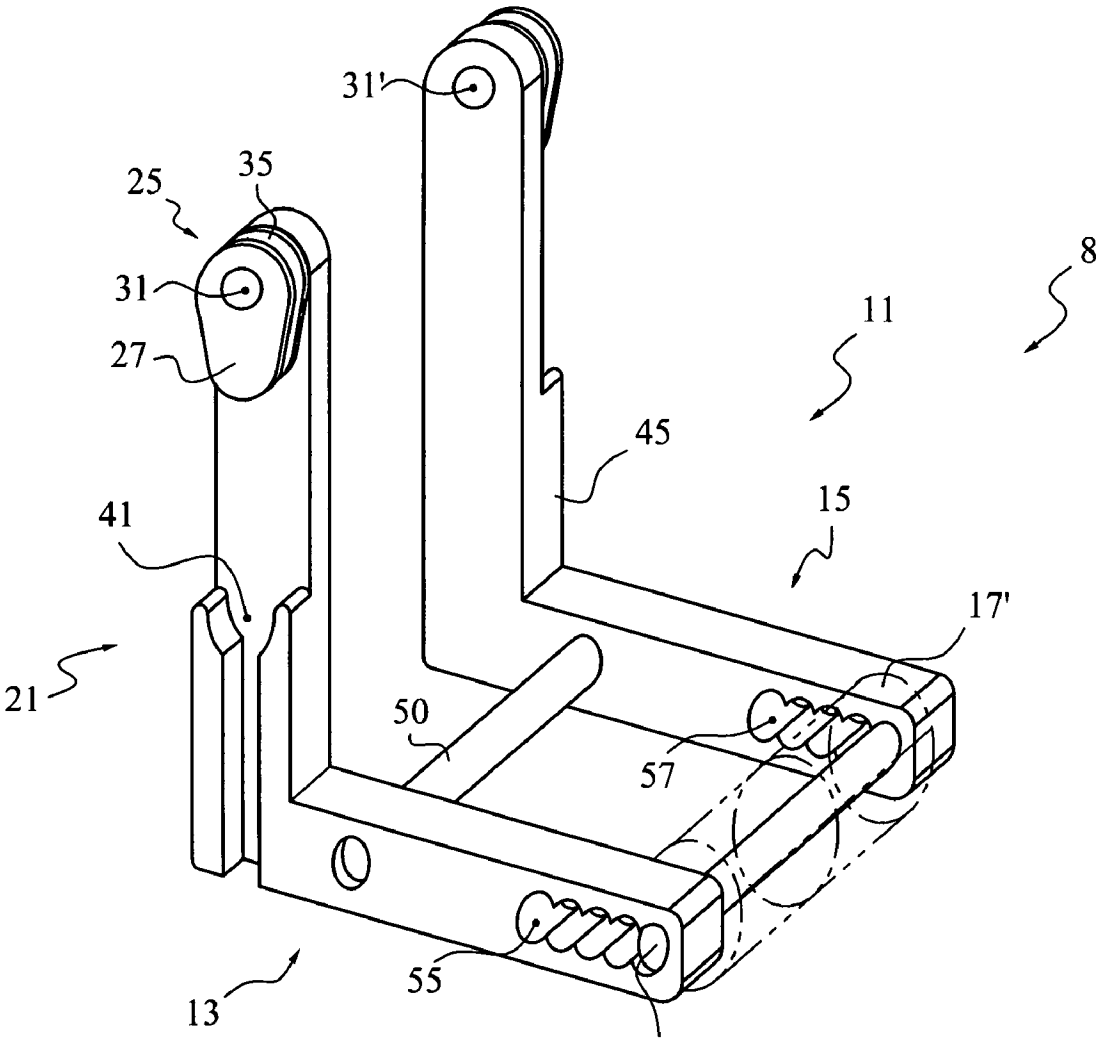
FIG. 1 is a perspective view of a suppressor structured according to certain principles of the invention.
Figure 2:
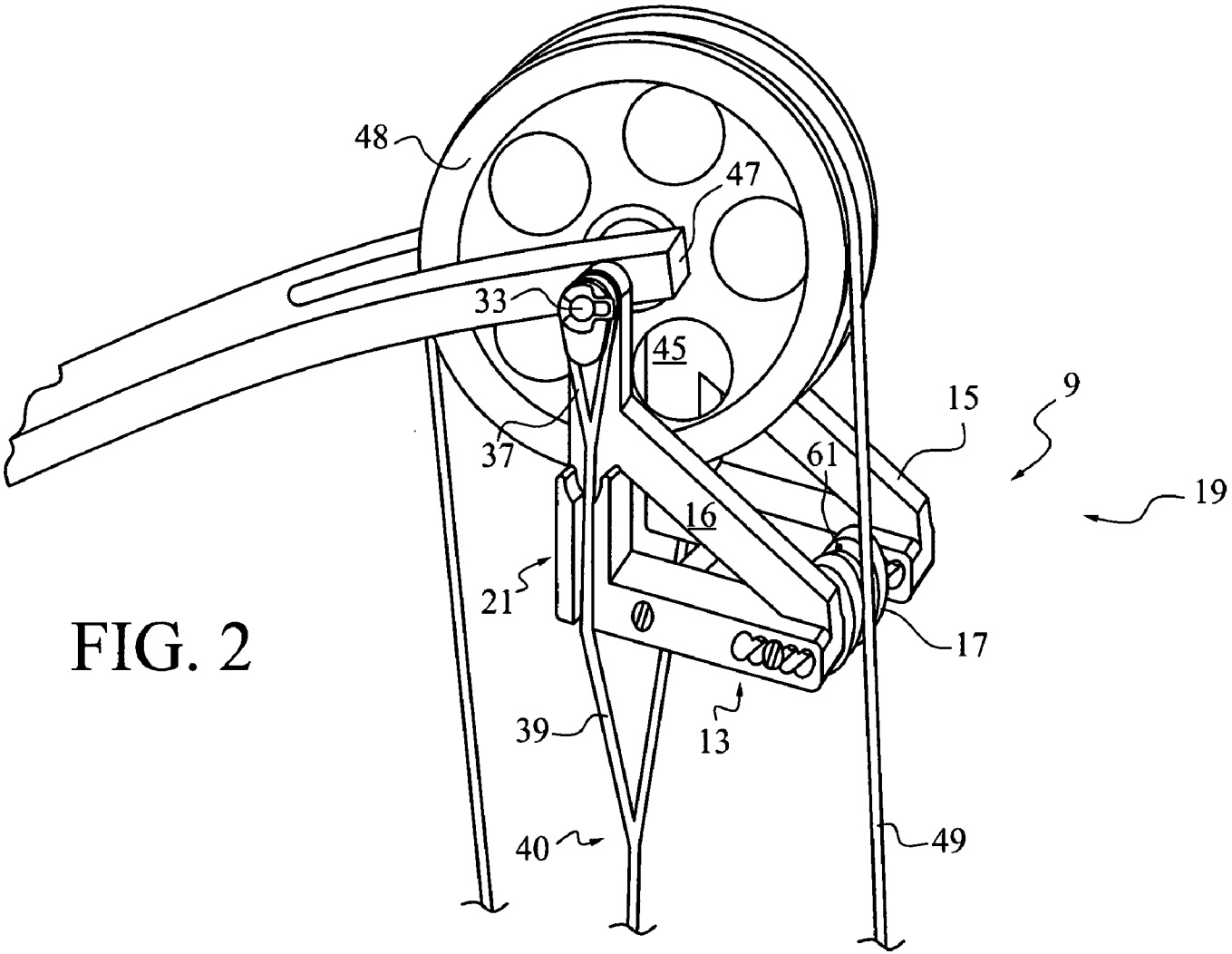
FIG. 2 is a perspective view of a typical compound archery bow limb with an embodiment of the invention in place.

First and second embodiments of string vibration suppressors are illustrated in FIGS. 1 and 2, generally at 8 and 9, respectively. The embodiments illustrated in FIGS. 1 and 2 are similar, differing only in minor details. They each comprise an accessory capable of incorporation into the yoke harness portion of the riggings for compound bows of widely varying construction. Similar devices can be customized to specific bow constructions and supplied as original equipment.

An operable frame structure, generally 11, comprises approximately parallel side supports, generally 13, 15, respectively. Each support may be roughly "L-shaped," as shown by FIG. 1. In one alternative construction, cross supports 16 may be added, as shown by FIG. 2, rendering the side supports generally triangular. It is apparent that many other configurations would be equally capable of holding a dampening member (bumper) 17, approximately as shown by FIG. 2, spaced apart between pulley assemblies of the bow and in contact with the bowstring at brace. Relative to other components of the associated rigging, generally 19, the bumper 17 should be non-interfering during operation of the bow, other than to perform its intended function.

With reference to FIGS. 1 and 2, the side support 13 includes a first element, generally 21, which in its normal position of use on a bow such as illustrated in FIG. 2, may be regarded as approximately vertical. The side support 13 includes a proximal end, generally 25, carrying journal mounting structure 27. This mounting structure 27 includes a central opening 31 shaped and dimensioned to receive an axle 33. Opening 31 comprises one operable attachment interface that associates a bowstring vibration suppressor with a bow limb.

Mounting structure 27 also has a peripheral groove 35 to receive the terminal end 37 of a first strand 39 of a yoke harness, generally 40. As illustrated, the cable groove 35 of an installed suppressor 9 is disposed for its rotation about axle 33 of the bow. As also illustrated, the strand 39 may be further captured by a channel 41 (FIG. 1). Element 21 may include a transverse dogleg shape (not illustrated) to place the channel 41 substantially in the natural plane of action of a cable end, such as cable end 37. The coupling channel 41 effectively resists undesired movement of a bumper component from an operable installed position. Such movement might otherwise result from the force of gravity or motion imparted by an archer.

Figure 3:
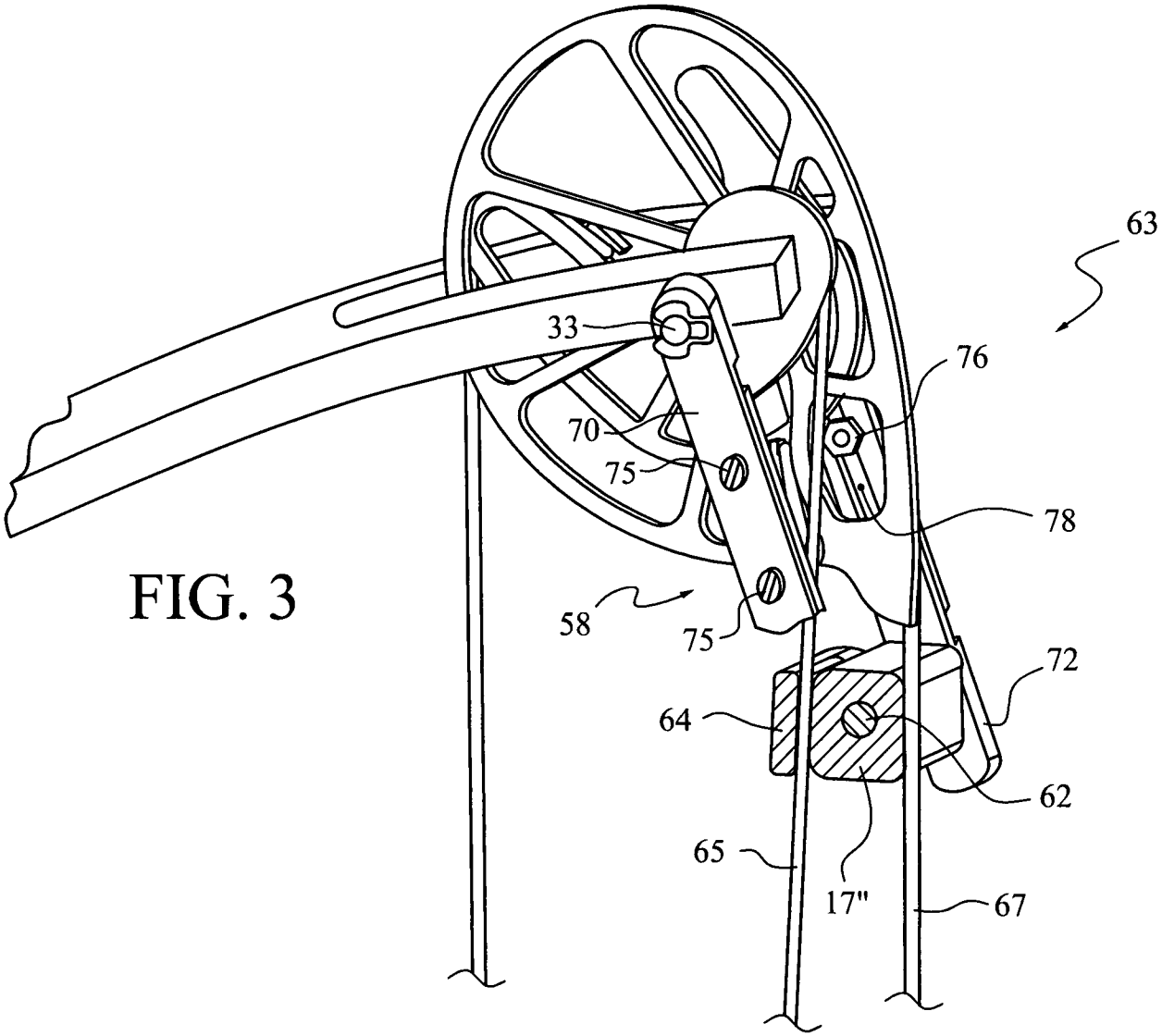
FIG. 3 is a perspective view, similar to FIG. 2, partially in section, with an alternative embodiment of the invention.

As illustrated in FIGS. 1 and 2, the structural element 45 is typically a substantially mirror image of the element 21. As best shown by FIG. 2, the elements 21, 45 may be suspended from opposite ends of the axle 33 in straddling relationship with the limb tip 47. FIGS. 1 and 2 illustrate embodiments of the invention in association with a yoke 40. FIG. 3 illustrates a version of the bowstring vibration suppressor of the invention installed in association with a rigging that includes no such yoke. The yoke arrangement illustrated in FIG. 2, distributes loading imparted from string contact with the bumper component 17 to both sides of the pulley element (e.g. 48 in FIG. 2, sometimes called a string cam, or bowstring cam) on which is wrapped the bowstring 49, thereby reducing displacement (and vibration) caused by a twisting moment applied to the limb tip.

With reference to FIG. 1, first and second spacer elements 50, 51 connect the side supports 13, 15 in their approximately parallel association. For certain embodiments, the spacing between the side supports 13, 15 is desirably adjustable along the spacers 50, 51, e.g. to accommodate limb tips 47 of various widths. It is currently preferred to anchor the bowstring vibration suppressor at widely spaced apart positions on an axle, but other design considerations may be accommodated by pivoting the side supports 13, 15 closer together.

As illustrated in FIG. 1, the opposite ends of the second spacer element 51 may be received by adjustment slots 55, 57. Repositioning of the spacer 51 within the slots 55, 57 adjusts the spacing of the dampening member 17 (or other embodiments, such as 17') from the axle 33. Such adjustment accommodates pulleys of various diameters. Typically, one or more fasteners is installed to maintain the spacer in a desired position. Alternative mechanisms operable to adjust the position of a bumper component (with respect to either a cable or structure such as axle 33) are within contemplation, including extendable support members, such as illustrated generally at 58 in FIG. 3. Vibration suppression appears to be most effective when the member 17 contacts the string close to, but out of contact with, the pulley 49.

A workable dampening component or bumper 17 may be of any convenient shape. It may have a varying or constant cross-section, as desired. The damping component 17 in FIG. 2 includes an optional groove 61 in which the bowstring is received. A first alternative form 17' of the dampening member component is shown (in phantom) supported by the second spacer element 51 in FIG. 1. A second alternative form 17" of the dampening member component is shown supported by the single spacer element 62 in FIG. 3.

Another embodiment of the string vibration suppressor of this invention is illustrated, generally at 63, in FIG. 3. Damping member 17" includes a cantilevered coupling arm 64, which is adapted to resist separation of the bumper 17" from the cable 65 during draw of the bowstring 67. Cantilevered arm 64 provides an open-ended slot into which a bowstring may be inserted. During installation of suppressor 63 onto a bow, the cable 65 is trapped between coupling arm 64 and damping member 17". The coupling arm 64 resists undesired movement of a bumper component from an operable installed position under the force of gravity, or due to motion imparted by an archer. Of course, many other structural arrangements would be equally effective to maintain the bumper 17" in coupled association with the cable 65.

An assortment of damping bumpers 17" having a plurality of sizes may be included in a kit. Such a kit permits selecting a bumper having a body size that inherently forms an extension member sized to span the gap between a cable 65 and a braced bowstring 67 of any particular bow. It is also within contemplation to provide a bumper component that includes structure that is adjustable to change the size (or length) of an extension member (e.g. as an alternative to the fixed-size body portion of bumper 17" spanning between the bowstring 67 and cable 65) effective to accommodate a plurality of bows, each bow having a different cable-to-bowstring spacing at brace.

The extendable support members 58 illustrated by FIG. 3 are configured to permit changing a spacing between a bumper 17" and an attachment interface, such as an opening 31 (see FIG. 1) disposed for contact with the axle 33. Illustrated support members 58 include an attachment part 70 and an extending part 72. One or more fastener 75 and cooperating nut 76 associated with slot 78 may be used to establish the spacing of a bumper carried on extending part 72 from structure such as axle 33. A variety of alternatively structured extendable members 58 will naturally occur to one of ordinary skill in the art, and are within the ambit of the instant invention. Again, it is within contemplation to incorporate an extension member into a bumper body, as one way to permit changing a size of the bumper to accommodate different spacing between bowstring and cable for different bows and for different rigging arrangements.

A string vibration suppressor structured in accordance with the instant invention may advantageously be disposed on either one or both of any top or bottom pulley assembly present in a particular bow rigging. For example, an embodiment such as illustrated in FIG. 2 may be carried on one limb tip of a "one cam" bow (e.g. on the pulley wheel end, as illustrated). Simultaneously, an embodiment such as illustrated in FIG. 3, may be installed on the other limb tip. An embodiment such as illustrated in FIG. 3 may be disposed at one or both of the limb tips of a "dual cam" bow, including a cross-coupled bow.

The embodiments illustrated by the drawings resist displacement of a bow limb caused by twisting torque applied to the bow limb tip by the bowstring. The load applied to the dampening bumper component by the bowstring is preferably distributed to both sides of the bow limb. Therefore, more energy is dissipated in bending the limb, compared to twisting the limb by loading it on a single side. Similar resistance to displacement caused by application of a twisting torque is present in embodiments where a first attachment interface (e.g. 31 in FIG. 1) and a second attachment interface (e.g. 31' in FIG. 1) are spaced apart on opposite sides of a bowstring cam element (e.g. 48 in FIG. 2) of a bow. It should be noted that an attachment interface within the ambit of the instant invention need not necessarily be disposed outboard of the limb.

A string slap force applied to bumper 17' (FIG. 1) is distributed between side members 13, 15, and applied in the same direction to the opposite ends of the axle on which the assembly 8 is mounted. While the force carried by each opposite member 13, 15 is not necessarily equal, there is a consequential decrease in twisting torque applied to twist the limb tip by such load-distribution, compared to a string suppressor anchored only to one side of a bow limb. Furthermore, application of a force to both sides of a limb inherently distributes the applied load over a larger cross-section (e.g. both limb elements of a split limb vs. only one of those limb elements.) However, it should be noted that certain embodiments within the ambit of the instant invention also may be anchored at only one side of a bow limb, as well as being coupled to a cable.

What is claimed is:

1. A string vibration suppressor for a compound bow that has rigging including a bowstring extending from a pulley member and a yoke harness with separate strands extending from respective opposite ends of an axle member supporting said pulley member at the distal end of a limb, such that the spacing between said bowstring and harness changes as said bowstring is moved between brace and drawn conditions, comprising:

first and second side supports constructed and arranged for support from opposite ends of such an axle member;

means associated with said side supports for connectively engaging respective strands of the yoke harness of such rigging;

spacer means for holding said side supports in approximately parallel association; and a bowstring vibration dampening bumper component held, by bumper-holding structure associated with said side supports, at a position selected to place said bumper component in contact with the bowstring of such rigging in brace condition and out of contact with said bowstring in drawn condition, when said strands are engaged by said side supports.

2. A string vibration suppressor according to claim 1, in combination with a compound bow that has rigging including a bowstring extending from a pulley member and a yoke harness extending from an axle member supporting said pulley member, such that the spacing between said bowstring and harness changes as said bowstring is moved between brace and drawn conditions, wherein:

said first and second side supports are pivotally connected to opposite ends of said axle member; and respective said strands of said yoke harness are positioned within structure carried by said side supports; whereby said bumper component is held in contact with said bowstring in brace condition of said bow.

3. A vibration suppressor for the bowstring of a compound bow, comprising:

an anchor element structured for mounting approximately at the distal tip of a limb of said bow to permit relative rotation between said anchor element and said limb;

a bowstring vibration dampening bumper component carried by structure associated with said anchor element to dispose said bumper component at a location spaced apart from and between respective bowstring pulley elements of said bow and in contact with said bowstring when said bowstring is near brace, and out of contact with said bowstring at full draw; and coupling structure, extending between said bowstring and a cable of the rigging of said bow, effective to transfer a portion of energy in the released bowstring into a transverse displacement of said cable.

4. The vibration suppressor of claim 3, wherein:

said coupling structure comprises an extension member disposed to transfer energy received from said bowstring into said cable at a mid-span location of said cable.

5. The vibration suppressor of claim 3, wherein:

said anchor element is configured to maintain said bumper component in spaced apart relation from at least one side of a limb tip of said bow.

6. The vibration suppressor of claim 5, wherein:

said anchor element comprises a first attachment interface adapted to couple with structure carried at an end of a limb of said bow.

7. The vibration suppressor of claim 6, further comprising:

a second attachment interface, said first and second attachment interface being spaced apart on opposite sides of a bowstring cam element of said bow.

8. The vibration suppressor of claim 5, further comprising:

adjustment structure operable to change a position of said bumper component with respect to an attachment interface of said anchor structure effective to accommodate pulley elements of different size when said suppressor is installed on a different bow.

9. A vibration suppressor for the bowstring component of the rigging of a compound archery bow, comprising:

anchor structure configured for pivotable mounting approximately at a distal end of a limb of said bow;

a bowstring vibration dampening bumper component being pivotally mounted with respect to said distal end; and location structure, extending from said anchor structure, effective to place said bumper component in contact with said bowstring, at a location spaced apart from and between respective string cams of said bow and when said bowstring is near brace condition of said bow, and out of contact with said bowstring in drawn condition of said bow.

10. The vibration suppressor of claim 9, wherein:

said anchor structure, comprises a first attachment interface and a second attachment interface, said first and second attachment interfaces being spaced apart on opposite sides of a string cam element of said bow.

11. The vibration suppressor of claim 10, wherein:

said first and second attachment interface are structured to couple with an axle of a pulley assembly of said bow.

12. The vibration suppressor of claim 10, wherein:

said first and second attachment interface are disposed outboard of said limb to substantially straddle the entire limb.

13. The vibration suppressor of claim 9, further comprising:

adjustment structure operable to change a position of said bumper component with respect to an attachment interface of said anchor structure effective to accommodate pulley elements of different size when said suppressor is installed on a different bow.

14. The vibration suppressor of claim 9, further comprising:

adjustment structure operable to change a position of said bumper component with respect to an attachment interface of said anchor structure effective to accommodate a different bowstring location at brace when said suppressor is installed on a different bow.

15. The vibration suppressor of claim 14, wherein:

said adjustment structure comprises a fastener adapted for anchoring at one of a plurality of locations spaced apart along an extension member, and thereby effective to dispose said bumper at a plurality of different positions.

16. The vibration suppressor of claim 14, wherein:

said adjustment structure comprises a length-adjustable extension member operable to change a distance of said bumper from said attachment interface.

17. The vibration suppressor of claim 14, wherein:

said adjustment structure comprises a width-changing arrangement operable to permit installation of said suppressor on a different bow requiring a different spacing between said first and second attachment interface.

18. The vibration suppressor of claim 9, wherein:

said anchor structure comprises coupling structure adapted to transfer energy from said bowstring into transverse displacement of a cable component of the rigging of said bow.

19. The vibration suppressor of claim 9, wherein:

said anchor structure comprises a first cable groove adapted to permit anchoring an end of a cable component of said bow onto said suppressor.

20. The vibration suppressor of claim 19, wherein:

said first cable groove of an installed said suppressor is disposed for its rotation about an axle of said bow.

* * * * *